United States Patent [19]

Kawaguchi

[11] 4,057,046

[45] Nov. 8, 1977

[54] BLOOD CIRCULATION STIMULATOR

[76] Inventor: Mamoru Kawaguchi, No. 100, Shimo-Nakashima, Arita, Wakayama, Japan

[21] Appl. No.: 687,372

[22] Filed: May 17, 1976

[30] Foreign Application Priority Data

June 14, 1975 Japan ..... 50-72387

[51] Int. Cl.[2] ..... A61H 1/00

[52] U.S. Cl. ..... 128/24 R

[58] Field of Search ..... 128/24 R, 60, 64, 298, 128/30.2, 30, 24.1

[56] References Cited

U.S. PATENT DOCUMENTS

| | | | |
|---|---|---|---|
| 1,172,660 | 2/1916 | Armbruster | 128/298 |
| 2,588,192 | 3/1952 | Akerman et al. | 128/30.2 |
| 2,674,231 | 4/1954 | Erickson | 128/24 R |
| 2,780,222 | 2/1957 | Polzin et al. | 128/30.2 |
| 3,885,554 | 5/1975 | Rockwell | 128/24 R |

*Primary Examiner*—Lawrence W. Trapp

*Attorney, Agent, or Firm*—Wenderoth, Lind & Ponack

[57] ABSTRACT

A blood circulation stimulator which helps to improve the circulation of blood by intermittently pressing the human body. It includes an air bag inflatable with compressed air, a solenoid valve for controlling an exhaust port in the compressed air supply line, and an electrical circuit for controlling the solenoid valve.

2 Claims, 3 Drawing Figures

BLOOD CIRCULATION STIMULATOR

This invention relates to a blood circulation stimulator which helps to stimulate the circulation of blood in the human body by subjecting it to repeated pressure application and release.

It is known that subjecting the human body to repeated application and release of external pressure stimulates the circulation of blood at the pressure-applied portion, thereby assisting in the cure of disease, and that the more quickly the pressure is released, the better.

It is an object of the present invention to provide a blood circulation stimulator which uses compressed air for the application and release of pressure and which controls the pressing cycle by means of a solenoid valve to ensure that pressure application and release are automatically repeated at regular intervals.

It is another object of the present invention to provide a blood circulation stimulator which is provided with means for enabling the solenoid valve both to keep closed an exhaust port for compressed air and to reclose it from its open position.

Other objects and advantages of the present invention will become apparent from the following description taken in connection with the accompanying drawings, wherein.

Figure 1:
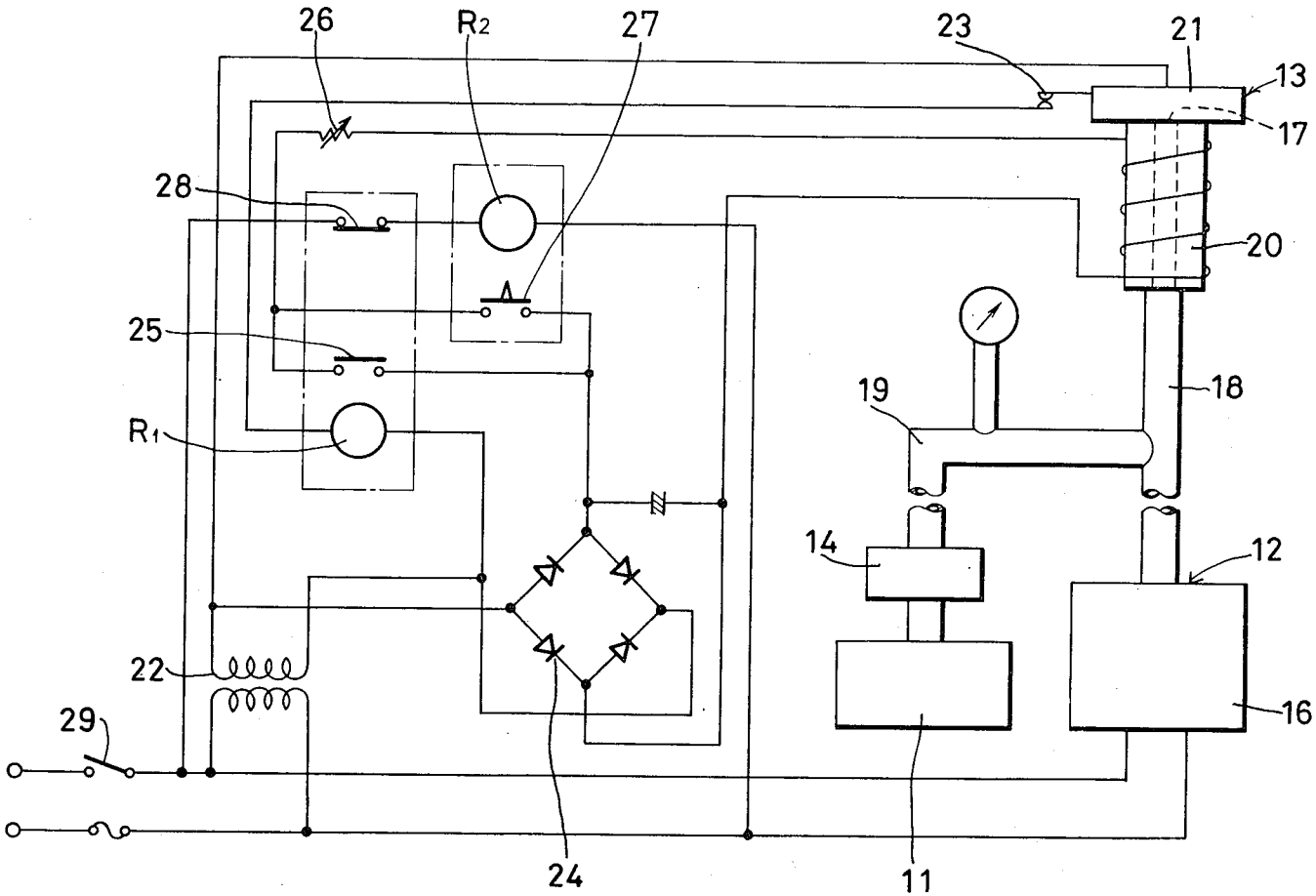
FIG. 1 is a schematic presentation in block form of an embodiment of the present invention.

Referring to the drawings, the blood circulation stimulator embodying the present invention comprises an inflatable and deflatable air bag 11 to be worn by a subject, compressed air supply system 12 which supplies compressed air to the air bag 11 to inflate it, a solenoid valve 13 for releasing compressed air at a predetermined time interval, and an exhaust valve 14 assisting in a rapid release of air out of the air bag 11.

Figure 2:
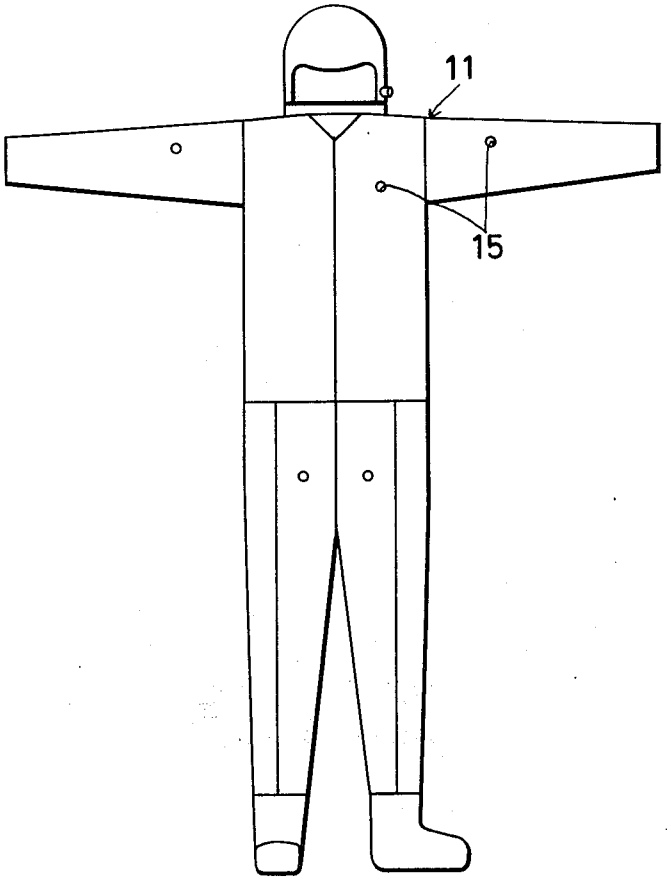
FIG. 2 is a front view of a person wearing an air bag used in the present invention.

Said air bag is preferably of a shape snugly fitting to the human body, for example, in the shape of tights covering the entire body including the head for the treatment of the entire body and provided with ports 15 for the supply and release of compressed air at required locations, as shown in FIG. 2.

The air bag 11 may be of a shape suitable for the treatment of only the upper or lower half of the body. It may also be in the form of a hood for the head and shoulder, an eye bandage for the eye, a sleeve for the upper arm, a glove for the hand, a stocking for the leg, a socks for the foot, a hat for the head and the like.

The air bag for the treatment of the abdomen, chest or a portion of limb may be shaped like a "manchette" or cuff used for blood pressure measurement. The air bag may be made of an airtight material similar to that of which a manchette or a life jacket is made.

Preferably, the air bag 11 is fastened to a body portion by use of a fastening band or the like so that it will not shift out of position.

The compressed air supply system 12, which supplies compressed air to the air bag 11, comprises e.g. an air compressor 16. Also provided are a compressed air pipe 18 having one end connected to the air compressor 16 and the other end being open to serve as an exhaust port 17, and an air supply pipe 19 branching from the air pipe 18 and having its end connected to the air bag 11.

An instantaneous exhaust valve 14 (not shown in detail) is provided in the compressed air supply pipe 19. It includes an exhaust port and a movable valve body adapted to close the exhaust port upon application of the pressure of compressed air through the air supply pipe 19 to inflate the air bag 11. When the exhaust port 17 opens so that a negative pressure prevails in the air supply pipe 19, the pressure of compressed air in the air bag 11 opens the instantaneous exhaust valve 14 so that air is rapidly discharged out of the air bag 11 therethrough. This arrangement assures rapid deflation of the air bag 11.

The solenoid valve 13 includes a solenoid 20 mounted to enclose the exhaust port 17 of the air pipe 18 and a magnetizable closure plate 21 disposed on the outer end of the solenoid 20 to be attracted thereto to close the exhaust port 17 upon energization of the solenoid 20.

The solenoid valve 13 holds the exhaust port 17 closed until the pressure in the compressed air pipe 18 overcomes the magnetizing power acting upon the closure plate 21, thus forcing open the latter to let out compressed air.

The inflation-contraction cycle should be properly adjusted according to the portion of the body to be treated, the kind of disease, etc. For example, the air bag 11 is kept inflated for 5 to 15 seconds and then kept deflated or under normal pressure for 5 to 15 seconds. Inflation and deflation are repeated in this cycle. This is accomplished by setting the magnetizing power of the solenoid valve 13 properly and holding the exhaust port 17 open for a predetermined time.

Next, the circuit for holding the exhaust port 17 open for a predetermined period of time will be described. It comprises at the secondary side of a transformer 22 a closed circuit having a relay R1 and contacts 23 closed by the closure plate 21, a solenoid energizing circuit having a rectifier 24, a variable resistor 26 and make contacts 25 actuated by relay R1, and another closed circuit having make contacts 27 connected in parallel with the make contacts 25, break contacts 28 connected to the power source and actuated by relay R1, and a delay relay R2 actuating the make contacts 27.

In operation, when a start switch 29 is turned on with the air bag 11 attached to a required body portion of the subject, relay R1 is actuated through the contacts 23 to close the make contacts 25 so that the solenoid 20 is energized to attract the closure plate 21, thus closing the exhaust port 17 and the contacts 23.

Simultaneously, the air compressor 16 is started to supply compressed air through the air pipe 18. Since the exhaust port 17 is closed, the compressed air passes through the air supply pipe 19 and the instantaneous exhaust valve 14 into the air bag 11 to inflate it to apply pressure to the body.

When the pressure of compressed air reaches a sufficiently high a level to overcome the power with which the closure plate 21 is attracted by the solenoid valve 13, said plate is pushed away from the solenoid 20 by compressed air to open the exhaust port 17.

It is necessary to adjust the pressure applied according to the portion of the body to be treated, the kind of disease, etc. This adjustment is accomplished by adjusting the variable resistor 26 to vary the magnetizing power for the solenoid 20.

When the exhaust port 17 opens, compressed air from the air compressor 16 is released into the air through the air pipe 18. When a negative pressure prevails in the air supply pipe 19, the instantaneous exhaust valve 14 opens to allow the compressed air to be rapidly discharged therethrough out of the air bag 11 to deflate the latter.

When the closure plate 21 is forced open, the contacts 23 open so that relay R1 is deenergized to open the make contacts 25, thus cutting off current to the solenoid 20. Thus, the exhaust port 17 is kept open. Simultaneously, the break contacts 28 close through relay R1 so that the delay relay R2 is energized.

A predetermined time after being energized, relay R2 operates to close the make contacts 27, thus reenergizing the solenoid 20 to close the exhaust port 17. Consequently, compressed air flows into the air bag 11 to inflate it again. The length of time for which it is left deflated can be adjusted by setting the delay relay R2.

As soon as the solenoid 20 moves the closure plate 21 into its closed position, the contacts 23 close to reenergize relay R1 so that the contacts 25 close and the contacts 28 open. Thus, the delay relay R2 and thus the contacts 27 open, but the solenoid 20 is held energized through the contacts 25. These steps are repeated to inflate and deflate the air bag 11 at predetermined time intervals.

Although in a preferred embodiment the closure plate 21 is movable while the solenoid 20 is fixed, the former may be fixed and the latter be movable.

Figure 3:
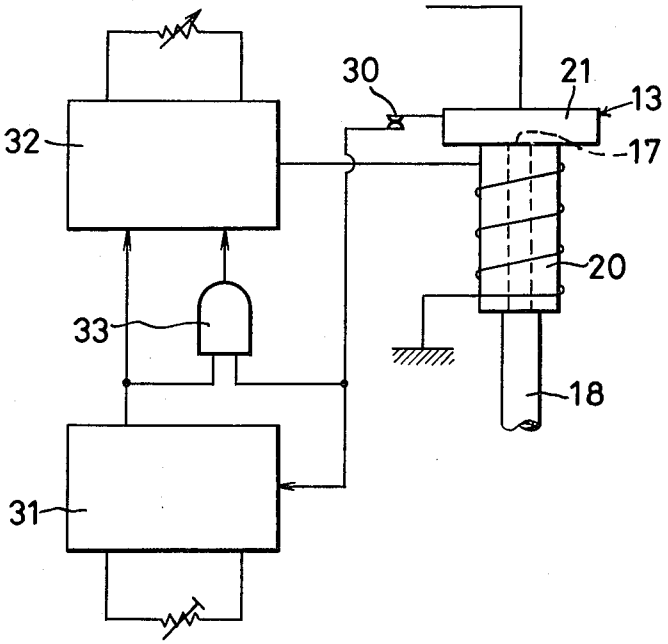
FIG. 3 is a schematic presentation in block form of another example of a solenoid valve control circuit in the present invention.

FIG. 3 illustrates a variation of an electrical circuit for controlling the solenoid valve 13, in which a timer is used to set the time from the release of compressed air to the next pressure application. It also assures secure reattraction of the closure plate 21 by the solenoid 20.

In this variation, too, the maximum applied pressure is determined by setting the magnetizing power for the solenoid 20. The current supplied thereto to hold the closure plate 21 closed is within a relatively limited range, although depending on the portion to be treated and the kind of disease.

However, the magnetic power required to reattract the closure plate 21 from its open position is larger than that required to hold it closed. Thus, if the solenoid 20 were supplied with only a smaller current required to hold closed the closure plate 21, it would fail to attract it.

To avoid this, the embodiment shown in FIG. 3 includes an AND gate to ensure that the solenoid 20 is supplied with a larger current only when it is required to reattract the closure plate 21 in its open position and with a reduced current after it has been attracted to the solenoid 20.

In FIG. 3, the contacts 30 adapted to close when the closure plate 21 is closed is connected to a timer 31, the output of which is fed to the input of an exciting current adjusting circuit 32 having its output connected to the solenoid 20. An AND gate 33 is inserted to bridge across the lead connecting the contacts 30 to the timer 31 and the lead connecting the timer 31 to the adjusting circuit 32, the output of said AND gate 33 being fed to the exciting current adjusting circuit 32.

When the pressure of compressed air overcomes the force with which the closure plate 21 is attracted by the solenoid valve 13, the closure plate 21 is pushed open so that the exhaust port 17 opens. Simultaneously, the contacts 30 open to input a start signal into the timer 31, which feeds a time signal to the current adjusting circuit 32 after a preset time.

This time signal and the start signal are also fed to the AND gate 33, which feeds a current amplification command signal to the current adjusting circuit 32. In response to this command signal, the current adjusting circuit 32 supplies a sufficiently large current to the solenoid 20 to cause it to reattract the closure plate 21 from its open position.

When it is attracted to the solenoid 20, the contacts 30 close so that the timer start signal to the timer 31 AND the AND gate 33 disappears. The latter stops feeding the current amplification command signal to the current adjusting circuit 32, which now receives only the signal from the timer 31 to apply a predetermined smaller current to the solenoid 20 to hold the exhaust port 17 closed by the closure plate 21.

It will be understood from the foregoing description that by controlling the inflation and deflation of the air bag by means of a solenoid valve for the exhaust port in the compressed air supply line, the blood circulation stimulator according to the present invention permits free adjustment of the inflation-deflation cycle and the maximum applied pressure and rapid deflation of the air bag with a simplified arrangement.

While preferred embodiments have been described, variations thereto will occur to those skilled in the art within the scope of the following claims.

What is claimed is:

1. A blood circulation stimulator comprising:

an airtight, inflatable air bag shaped to fit in substantially airtight relationship with at least a part of the human body;

compressed air supply means for supplying compressed air;

a conduit connected to said compressed air supply means and having an exhaust port, and a branch conduit connected to said conduit and to said air bag to supply compressed air to said air bag;

a two-position valve at said exhaust port for closing said exhaust port in one position and opening said exhaust port in the other position, and solenoid means connected to said valve for urging said valve to the closed position when energized and forced to the open position by compressed air to open said exhaust port when the pressure of air in said conduit overcomes the magnetic force of said solenoid means; and an electrical circuit coupled to said solenoid means for energizing said solenoid means to move said valve to close said exhaust port and hold said valve closed until the force of the solenoid means is overcome, and electrically detecting the movement of said valve for opening of said exhaust port and re-energizing said solenoid means a predetermined time after said opening to reclose said exhaust port, thereby subjecting the human body to repeated application and release of pressure, and a further negative pressure responsive exhaust valve in which said branch conduit for assisting rapid release of compressed air from said air bag when said exhaust port is opened.

2. A blood circulation stimulator as claimed in claim 1 wherein said electrical circuit comprises means for supplying said solenoid means with a larger current when said valve is in the open position and is to be moved to the closed position and with a smaller current for holding the valve in the closed position after it has been closed by the solenoid means.

* * * * *